United States Patent [19]

Hastings-James et al.

[11] 4,300,022

[45] Nov. 10, 1981

[54] MULTI-FILAR MOVING COIL LOUDSPEAKER

[75] Inventors: Richard Hastings-James, Halifax; George W. Holbrook, Tantallon, both of Canada

[73] Assignee: Canadian Patents & Dev. Limited, Ottawa, Canada

[21] Appl. No.: 55,792

[22] Filed: Jul. 9, 1979

[51] Int. Cl.[3] ..... H04R 3/00; H04R 9/04

[52] U.S. Cl. ..... 179/115.5 DV; 179/1 F

[58] Field of Search ..... 179/115.5 DV, 115.5 VC, 179/115.5 R, 1 F

[56] References Cited

U.S. PATENT DOCUMENTS

| | | | |
|---|---|---|---|
| 1,822,758 | 9/1931 | Toulon | 179/1 F |
| 1,969,657 | 8/1934 | McCaa | 179/115.5 DV X |
| 2,194,175 | 3/1940 | Wilhelm | 179/1 F |
| 2,860,183 | 11/1958 | Conrad | 179/1 F |
| 2,925,541 | 2/1960 | Koch | 179/115.5 VC X |
| 3,196,211 | 7/1965 | Kessenich | 179/115.5 DV X |
| 3,542,952 | 11/1970 | Wang | 179/1 F |

FOREIGN PATENT DOCUMENTS

| | | | |
|---|---|---|---|
| 1083863 | 6/1960 | Fed. Rep. of Germany | 179/115.5 VC |

*Primary Examiner*—Thomas W. Brown
*Attorney, Agent, or Firm*—Edward Rymek

[57] ABSTRACT

The multi-filar moving coil loudspeaker includes a magnetic field structure which provides a unidirectional magnetic flux across an air gap, an acoustic diaphragm, and a coil set positioned in the air gap and connected to the diaphragm. The coil set has a plurality of insulated coils wherein the coils have approximately the same resistance and inductance and cut substantially the same flux lines in the air gap. The coil set has two or more wires which are twisted around one another and then wound about a coil form. The coils in the coil set may be connected in series or parallel aiding, or in series bucking pairs. In a loudspeaker circuit, the coils are connected into two groups, each having one or more coils. The first group is connected to input terminals, and the second group is connected to a feedback amplifier having an output connected to the first group of coils. The amplifier may be a constant voltage amplifier having an output connected in series with the first group of coils, or a constant current amplifier connected in parallel with the first group of coils. In the first case, a further inductance may be connected in series with the first group of coils and in the latter case a capacitance may be connected across the first group of coils.

9 Claims, 12 Drawing Figures

MULTI-FILAR MOVING COIL LOUDSPEAKER

BACKGROUND OF THE INVENTION

This invention is directed to a loudspeaker and in particular to a multifilar moving-coil loadspeaker.

In a moving coil loudspeaker, the mechanical force on a circular moving coil is developed by the interaction of the current in the coil or coils and the transverse magnetic field disposed radially across a gap in a dc or permanent magnet circuit. The output force which is along the axis of the circular coil or coils is applied to a sound radiator or diaphragm.

Single and multiple moving coil speakers with corresponding circuits have been developed over the years to resolve various problems. Some of these are described in U.S. Pat. No. 1,969,657 which issued on Aug. 7, 1934 to McCaa, U.S. Pat. No. 3,196,211 which issued on July 20, 1965 to Kessenick and German Pat. No. 1,047,843 which issued on Mar. 31, 1960.

SUMMARY OF THE INVENTION

It is therefore an object of this invention to provide a multifilar moving coil loudspeaker.

It is a further object to provide a loudspeaker circuit which is substantially resistive in the audio frequency range.

It is another object to provide an efficient loudspeaker circuit.

These and other objects are achieved in a moving coil loudspeaker having a magnetic field structure for providing unidirectional magnetic flux across an air gap, an acoustic diaphragm, and a coil set positioned in the air gap and connected to the diaphragm. The coil set includes a plurality of insulated coils wherein the coils have approximately the same resistance and inductance and cut substantially the same flux lines in the air gap. The coil set may include two or more wires twisted around one another and wound onto a coil form. The coils can be connected in series or parallel aiding, or in series bucking pairs.

In a loudspeaker circuit, the coils may be connected into two groups, each having one or more coils. The first group is connected to input terminals to which an input signal may be applied. The second group is connected to a feedback amplifier having its output connected into the first group.

The amplifier may be a constant voltage amplifier having an output connected in series with the first group of coils. The amplifier gain may be set at unity. In addition, the circuit may include an inductance connected in series with the first group of coils.

In a second circuit the amplifier may be a constant current amplifier having an output connected in parallel with the first group of coils. This circuit further includes a capacitance connected across the first group of coils.

Many other objects and aspects of the invention will be clear from the detailed description of the drawings.

DESCRIPTION OF THE PREFERRED EMBODIMENT

Figure 1:
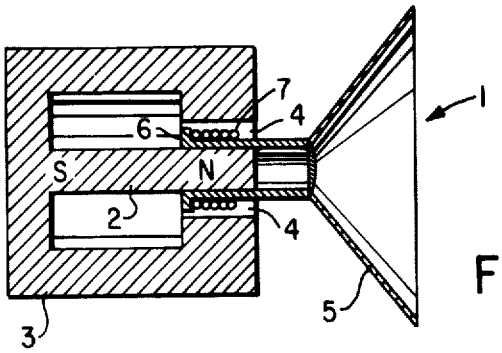
FIG. 1 PRIOR ART
FIG. 1 illustrates a typical moving-coil loudspeaker.

The loudspeaker 1 shown in FIG. 1 represents in cross-section, the essential components of a moving coil loudspeaker. The speaker 1 includes a cylindrical shaped unidirectional magnet 2 which is usually a permanent magnet but may be a dc magnet. Attached to the magnet 2 is a cylindrical housing 3 made of high permeability material to provide a return path for the magnetic flux. The housing 3 is made to provide a thin air gap 4 between the magnet 2 and the housing 3. An acoustic diaphragm 5 is connected to a cylindrical coil form 6 which is located over the end of the magnet 2. Coil 7 is wound on the coil form 6 so as to be located in the air or flux gap 4 such that when a signal in the acoustic range is connected to coil 7, the current flow in coil 7 forces coil 7 and thus the form 6 and the diaphragm 5 to move producing an audible sound. The reverse is also true in that when the diaphragm 5 is moved, coil 7 will move cutting flux lines and generating a current in coil 7 making the loudspeaker operate as a microphone.

A moving-coil loudspeaker in accordance with the present invention includes a coil set 10 made up of two or more insulated wires 11. The coil wires 11 are substantially of the same length, and the wires 11 in the set 10 are twisted around one another, as shown in FIG. 2, before they are wound about a coil form 12 to form the coil set 10 as shown in FIG. 3.

Figure 2:
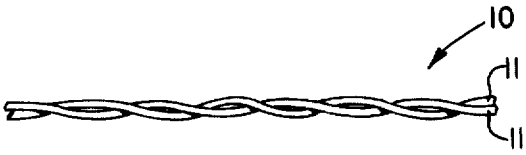
FIG. 2 illustrates wires used in a coil set in accordance with the present invention.
Figure 3:
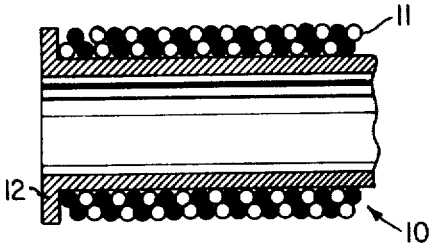
FIG. 3 illustrates coils on a former in accordance with the present invention.
Figure 4:
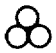
FIG. 4 illustrates a 3 wire coil set.
Figure 5:
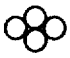
FIG. 5 illustrates a 4 wire coil set.
Figure 6:
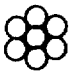
FIG. 6 illustrates a 7 wire coil set.

The coil set 10 may be made from two coil wires 11 as shown in FIG. 2, however, three, four or more wires may be used in a set 10. The number of wires 11 used in a coil set 10 may depend on the number of coils needed as well as the packing ability of particular arrangements. As shown, for example, in FIGS. 4, 5 and 6, three, four and seven wires 11 are twisted together to form a set 10.

By twisting a number of wires 11 together and mounting them on a coil former 12, the coils in the set have near identical properties. The coils are of substantially identical lengths and therefore have substantially identical resistance. The coils have a substantially identical number of turns and therefore have substantially identical inductance. The coils are substantially identical in shape and are intimately entwined and therefore the coils cut the same flux lines in the flux gap of the magnetic field resulting in a coefficient of coupling k between coils to be substantially 1 and a substantially identical back emf being generated in each coil.

Figure 7:
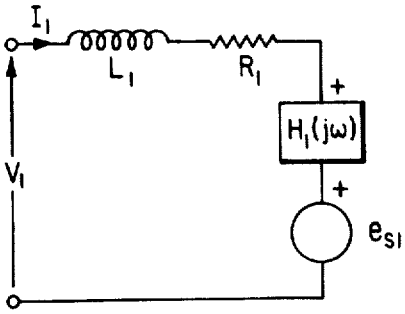
FIG. 7 illustrates the equivalent circuit for a single coil.

Each coil, if taken along with all other coils open circuited, can be represented by the equivalent circuit shown in FIG. 7. It includes an inductance $L_1$, a resistance $R_1$, an equivalent electromechanical impedance $H_1 = H_1(j\omega)$ due to back emf and an additional back emf due to microphone action or other external mechanical excitation of the coil. The voltage $V_1$ across the coil is then:

$$V_1 = (j\omega L_1 + R_1 + H_1(j\omega))I_1 + e_{s1}$$

where $I_1$ is the current through the coil.

In the moving-coil loudspeaker in accordance with the present invention, a coil set includes two or more identical coils. These coils may be interconnected in various ways into one or more active coil groups, with or without accompanying circuits to respond to a particular design requirement. Basically, any two coils in a set may be connected either series-aiding, series-bucking, or parallel-aiding.

A coil set may include combinations of the above with other coils to form coil groups wherein the impedances are multiples of one another. In addition, one or more coils may be left open circuited or connected to a high impedance monitor. Finally, coil groups may be connected into circuits so as to improve the performance of the loudspeaker.

The parallel-aiding circuit is the simplest to analyse since it provides an impedance which is half of the impedance of a single coil.

Figure 8:
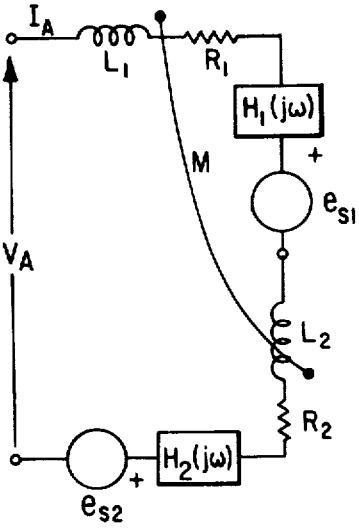
FIG. 8 illustrates the equivalent circuit for two coils connected in series-aiding.

The equivalent circuit for two coils connected in series-aiding is shown in FIG. 8, $V_A$ being the voltage across the coils and $I_A$ the current through the coils.

In this circuit:

$$V_A = [(R_1 + R_2) + j\omega(L_1 + L_2 + 2M) + H_1(j\omega) + H_2(j\omega)]I + e_{s1} + e_{s2}$$

where $R_1 = R_2 = R$ the resistance of each coil $L_1 = L_2 = L$ the inductance of each coil $M = k\sqrt{L_1 L_2} = kL$ the mutual inductance of each coil $H_1(j\omega) = H_2(j\omega) = H(j\omega)$ the impedance due to back emf $e_{s1} = e_{s2} = e_s$ the emf due to microphone action and therefore $$V_A = 2\{[R + j\omega(1+k)L + H(j\omega)]I_A + e_s\}$$

with $e_s = 0$ and $k = 1$ $$Z_A = (V_A/I_A) = 2[R + j\omega 2L + H(j\omega)]$$

Figure 9:
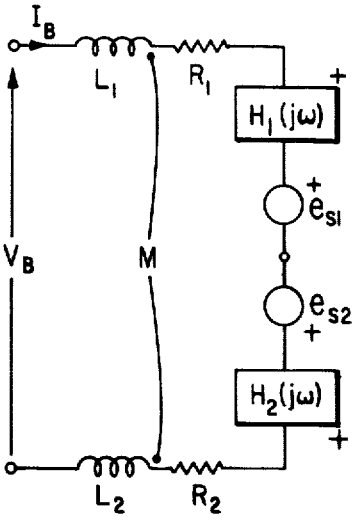
FIG. 9 illustrates the equivalent circuit for two coils in series-bucking.

The equivalent circuit for two coils connected in series-bucking is shown in FIG. 9, $V_B$ being the voltage across the coils and $I_B$ the current through the coils. In this circuit:

$$V_B = [(R_1 + R_2) + j\omega(L_1 + L_2) - j\omega 2M + H_1(j\omega) - H_2(j\omega)]I_B + e_{s1} - e_{s2}$$

where $R_1 = R_2 = R$ the resistance of each coil $L_1 = L_2 = L$ the inductance of each coil $M = k\sqrt{L_1 L_2} = kL$ the mutual inductance of each coil $H_1(j\omega) = H_2(j\omega) = H(j\omega)$ the impedance due to back emf $e_{s1} = e_{s2} = e_s$ the emf due to microphone action and therefore $$V_B = 2\{[R + j\omega(1-k)L]I_B\}$$

regardless of the value of $e_s$;

with $k = 1$ $$Z_B = (V_B/I_B) = 2R$$

The impedance is entirely resistive in this case and is therefore constant with frequency. Though such a device would not have any output as a loudspeaker, a microphone signal would be produced across either coil.

Figure 10:
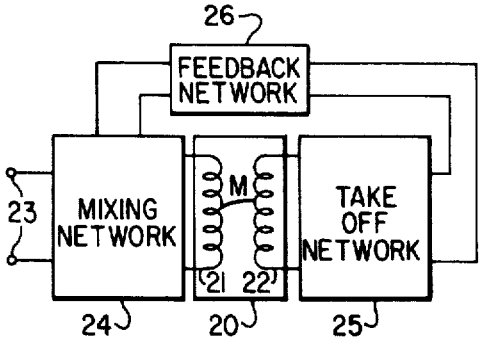
FIG. 10 illustrates a feedback loudspeaker circuit.

In order to improve the efficiency of a loudspeaker in accordance with the present invention, it may be combined in a feedback system as illustrated schematically in FIG. 10. The loudspeaker 20 has two coil groups 21 and 22. Coil group 21 is connected to the input terminals 23 through a mixing network 24 which combines the input signal and the feedback signal. The coil group 22 is connected through a take-off network 25 to a feedback network 26 which generates the feedback signal to the mixing network 24. Using this feedback arrangement, the active impedance of the circuit may be eliminated and the back emf of the coils may be eliminated or enhanced by adjusting the amplifier gain.

Figure 11:
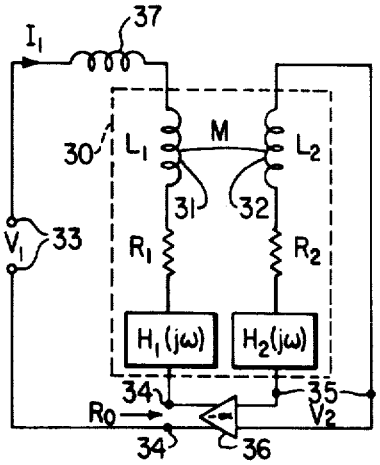
FIG. 11 illustrates a loudspeaker circuit having a constant voltage amplifier.

One feedback circuit is illustrated in FIG. 11. The loudspeaker 30 includes two coil groups 31 and 32 represented by impedances $L_1$, $R_1$, $H_1(j\omega)$ and $L_2$, $R_2$, $H_2(j\omega)$, respectively, and have a mutual inductance M. The coil groups need not be identical and may be made from interconnected coils as discussed above. The output $V_2$ from the second coil group 32 is taken from across terminals 35 and applied to a constant voltage amplifier 36 having a high input impedance and a low output impedance. The gain of amplifier 36 is set at $-\alpha$. The input signal $V_1$ is applied across input teminals 33, which are connected to an inductance 37 in series with coil groups 31. Input signal $V_1$ is combined with the output of amplifier 36 at terminals 34. In this circuit:

$$V_1 = I_1[(j\omega L_{37} + R_1 + j\omega L_1 + H_1(j\omega) + R_o] - \alpha V_2$$

where $R_o$ is the output impedance of amplifier 36; and $$V_2 = I_1[j\omega M + M_2(j\omega)]$$

since no current flows in the coil group 31. Therefore, $$V_1 = I_1[j\omega L_{37} + R_1 + j\omega L_1 + H_1(j\omega) + R_o] - \alpha I_1[j\omega M + H_2(j\omega)]$$

and $$Z_1 = (V_1/I_1) = R_1 + H_1(j\omega) - \alpha H_2(j\omega) + R_o + j\omega(L_{37} + L_1 - \alpha M)$$

since $H_1(j\omega) = H_2(j\omega)$ and $L_1 = L_2 = M$.

The inductance may be eliminated in the circuit if the amplifier gain $\alpha$ is set such that:

$$L_{37} + L_1 = \alpha M = \alpha L$$

$$\text{or } \alpha = (L_{37} + L_1)/L_1$$

$$\text{then } Z_1 = R_1 + R_o + H_1(j\omega)(1-\alpha).$$

$\alpha$ may take on any value and therefore the importance of $H_1(j\omega)$ in the circuit decreases as $\alpha \rightarrow 1$. In the special case, when $\alpha = 1$, $L_{37} = 0$ since $$\alpha = (L_{37} + L)/L = 1.$$

However, in this case, the loudspeaker has no microphone action. By making $\alpha$ greater than unity the efficiency of the device as both loudspeaker and microphone may be enhanced.

Figure 12:
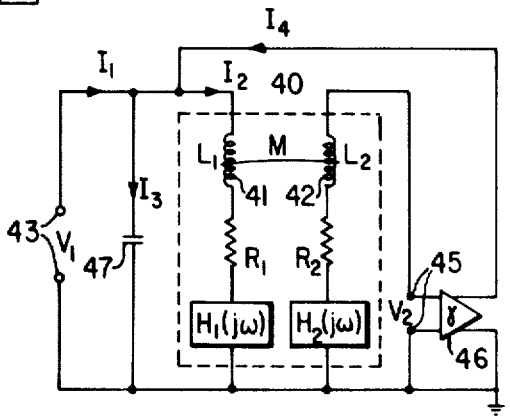
FIG. 12 illustrates a loudspeaker circuit having a constant current amplifier.

FIG. 12 illustrates a second loudspeaker feedback system for a loudspeaker by impedances $L_1$, $R_1$, $H_1(j\omega)$ and $L_2$, $R_2$, $H_2(j\omega)$ respectively, with mutual inductance M. Coil group 41 is connected across input terminals 43 to which is applied signal $V_1$. The output $V_2$ from the second coil is applied to terminals 45 to which is connected a constant current amplifier 46 having a high input impedance and a high output impedance. The gain of amplifier 46 is set at $\delta$ and the output is connected in parallel with input terminals 43. In addition, a capacitor 47 is connected across terminals 43.

In this circuit:

$$I_4 = \gamma V_2 = \gamma I_5[H_1(j\omega) + j\omega M]$$

$$I_5 = \frac{V_1}{R_1 + j\omega L_1 + H_1(j\omega)}$$

$$I_3 = V_1 j\omega C_{47}$$

$$I_1 = I_5 + I_3 - I_4$$

$$= \frac{V_1}{R_1 + j\omega L_1 + H_1(j\omega)} + V_1 j\omega C_{47} - \frac{\gamma V_1[H_1(j\omega) + j\omega M]}{R_1 + j\omega L_1 + H_1(j\omega)}$$

$$= \frac{I_1}{V_1}$$

$$= \frac{1 - \gamma H_1(j\omega) - \omega^2 L_1 C_{47} + j\omega(C_{47}R_1 + C_{47}H_1(j\omega) - \gamma M)}{R_1 + H_1(j\omega) + j\omega L_1}.$$

For the impedance of the circuit to be resistive, the phase angles of the numerator and the denominator must be identical, i.e. the ratio of the real to the imaginary part of the numerator is equal to the ratio of the real to the imaginary part of the denominator, and $$\frac{C_{47}R + C_{47}H_1(j\omega) - \gamma M}{1 - \gamma H_1(j\omega) - \omega^2 L_1 C_{47}} = \frac{L_1}{R_1 + H_1(j\omega)}.$$

At medium frequencies, $\omega^2 LC$ may be neglected and therefore, since $M = L_1 = L_2$ $$\gamma = \frac{C_{47}/L_1[R_1 + H_1(j\omega)]^2 - 1}{R_1}$$

and with $H_1(j\omega) << R_1$ $$= \frac{R_1 C_{47}}{L_1} - \frac{1}{R_1}$$

which results in a loudspeaker which is resistive.

The above circuit provides loudspeakers which are resistive and have a substantially constant input impedance over the audio frequency range. In addition, the loudspeaker system exhibits improved efficiency both as a loudspeaker and as a microphone.

Many modifications in the above described embodiments of the invention can be carried out without departing from the scope thereof and therefore the scope of the present invention is intended to be limited only by the appended claims.

We claim:

1. A moving coil loudspeaker comprising:

magnetic field structure means for providing unidirectional magnetic flux across an air gap;

acoustic diaphragm means; and coil means positioned in the air gap and connected to the diaphragm means, said coil means having two or more insulated wires twisted around one another and wound onto a coil form, to form coils having approximately the same resistance and inductance and cutting substantially the same flux lines in the air gap.

2. A moving coil loudspeaker as claimed in claim 1 in which the coils are connected in series aiding.

3. A moving coil loudspeaker as claimed in claim 1 having one or more pairs of coils connected in series bucking.

4. A moving coil loudspeaker as claimed in claim 1 wherein the coils are connected into first and second groups each having one or more coils; the first group being connected to input terminals, and the second group being connected to feedback amplifier means having an output connected to the first group.

5. A moving coil loudspeaker as claimed in claim 5 wherein the amplifier means is a constant voltage amplifier having an output connected in series with the first group of coils.

6. A moving coil loudspeaker as claimed in claim 6 wherein the amplifier gain is 1.

7. A moving coil loudspeaker as claimed in claim 6 which further includes inductance means connected in series with the first group of coils, and wherein the amplifier gain is greater than unity.

8. A moving coil loudspeaker comprising:

magnetic field structure means for providing unidirectional magnetic flux across an air gap;

acoustic diaphragm means;

coil means positioned in the air gap and connected to the diaphragm means, said coil means having a plurality of insulated coils having approximately the same resistance and inductance and cutting substantially the same flux lines in the air gap, and the coils being connected into first and second groups each having one or more coils, the first group being connected to input terminals;

capacitance means connected to the input terminals in parallel to the first group of coils; and a constant current feedback amplifier with an input coupled to the second group of coils and an output coupled to the input terminals in parallel to the first group of coils.

9. A moving coil loudspeaker as claimed in claim 8 wherein the coil means consists of two or more wires twisted around one another and wound onto a coil form.

* * * * *